US006009561A

United States Patent [19]

Bullock et al.

[11] Patent Number: 6,009,561

[45] Date of Patent: Jan. 4, 2000

[54] HELMET WITH ROTATABLE ACCESSORY MOUNT AND METHOD OF MAKING THE SAME

[75] Inventors: Christopher Bullock, San Jose; Michael Grim; Flint Thorne, both of Santa Cruz, all of Calif.

[73] Assignee: Bell Sports Inc., San Jose, Calif.

[21] Appl. No.: 09/140,615

[22] Filed: Aug. 26, 1998

[51] Int. Cl.[7] ..... A42B 3/04

[52] U.S. Cl. ..... 2/422; 2/12; 411/508; 24/297

[58] Field of Search ..... 2/410, 411, 422, 2/424, 425, 6.2, 6.3, 6.4, 10, 12; 24/297; 411/45, 913, 508

[56] References Cited

U.S. PATENT DOCUMENTS

| | | | |
|---|---|---|---|
| 1,347,046 | 7/1920 | McDonough . | |
| 1,522,024 | 1/1925 | Nixon, Jr. . | |
| 2,115,065 | 4/1938 | Dym . | |
| 2,123,375 | 7/1938 | Dym . | |
| 3,082,428 | 3/1963 | Zbikowski . | |
| 3,087,166 | 4/1963 | Howard . | |
| 3,171,133 | 3/1965 | Steffen . | |
| 3,208,080 | 9/1965 | Hirsch . | |
| 3,239,842 | 3/1966 | Marchello | 2/422 |
| 3,310,811 | 3/1967 | Iacono, Jr. . | |
| 3,344,433 | 10/1967 | Stapenhill . | |
| 3,465,363 | 9/1969 | Raney . | |
| 3,496,854 | 2/1970 | Feldmann et al. . | |
| 3,529,306 | 9/1970 | Thorne . | |
| 3,582,990 | 6/1971 | Frieder . | |
| 3,591,863 | 7/1971 | Rickard . | |
| 3,790,962 | 2/1974 | Plastino . | |
| 3,925,821 | 12/1975 | Lewicki . | |
| 3,934,271 | 1/1976 | Rhee . | |
| 3,991,423 | 11/1976 | Jones . | |
| 3,992,722 | 11/1976 | Rhee . | |
| 4,054,953 | 10/1977 | De Barsy . | |
| 4,058,854 | 11/1977 | Rhee . | |
| 4,068,323 | 1/1978 | Gwon . | |

(List continued on next page.)

FOREIGN PATENT DOCUMENTS

| | | |
|---|---|---|
| 2 108 427 | 4/1995 | Canada . |
| 0 042 782 | 12/1981 | European Pat. Off. . |
| 0 096 148 | 6/1982 | European Pat. Off. . |
| 0 394 726 A1 | 10/1990 | European Pat. Off. . |
| 2 241 267 | 4/1975 | France . |
| 2 294 659 | 8/1976 | France . |
| 2 335 168 | 8/1977 | France . |
| 2 340 066 | 10/1977 | France . |
| 29 41 019 | 4/1981 | Germany . |
| 36 32 525 A1 | 3/1988 | Germany . |
| WO 89/01744 | 3/1989 | WIPO . |

*Primary Examiner*—Michael A. Neas
*Attorney, Agent, or Firm*—Limbach & Limbach L.L.P.

[57] ABSTRACT

A helmet and method of making the same for allowing repeatably removable and adjustable attachment of helmet accessories, that includes an inner liner member for substantially covering a wearer's head, and an outer shell member that includes an upper shell surface, a lower shell surface which substantially covers an upper liner surface of the inner liner member, and at least one mounting hole formed therethrough. A grommet with a access hole formed therethrough is attached to the outer shell so that the access hole is aligned with the mounting hole. A helmet accessory has at least one mounting member insertable through the access hole. An engagement member is rotatably attached to the grommet with a predetermined amount of friction therebetween, and has means for removably engaging the helmet accessory mounting member inserted through the access hole for removably mounting the helmet accessory to the helmet. The predetermined amount of friction is selected to be low enough to allow a wearer of the helmet to rotate the helmet accessory between various rotational positions, yet high enough to selectively hold the helmet accessory in any of the various rotational positions.

39 Claims, 9 Drawing Sheets

U.S. PATENT DOCUMENTS 4,081,865 4/1978 Bergee et al. .
4,115,874 9/1978 Hasegawa .
4,141,085 2/1979 Adams, Sr. .
4,300,242 11/1981 Nava et al. .
4,449,275 5/1984 Nava .
4,477,929 10/1984 Mattsson .
4,514,864 5/1985 Huber .
4,519,099 5/1985 Kamiya et al. .
4,534,068 8/1985 Mitchell et al. .
4,538,303 9/1985 Schnitzler .
4,555,816 12/1985 Borersma .
4,599,752 7/1986 Mitchell .
4,612,675 9/1986 Broersma .
4,622,700 11/1986 Sundahl .
4,627,115 12/1986 Broersma .
4,698,856 10/1987 Arai .
4,700,411 10/1987 Kawasaki et al. .
4,744,107 5/1988 Fohl ..... 2/422
4,766,614 8/1988 Cantwell et al. .
4,865,505 9/1989 Okada ..... 411/512
4,878,792 11/1989 Frano ..... 411/339
4,884,301 12/1989 Aileo .
4,995,117 2/1991 Mirage .
5,010,598 4/1991 Flynn et al. .
5,058,212 10/1991 Kamata .
5,083,320 1/1992 Halstead .
5,083,321 1/1992 Davidsson .
5,086,520 2/1992 Arai .
5,093,937 3/1992 Kamata .
5,093,938 3/1992 Kamata .
5,099,523 3/1992 Broersma .
5,119,516 6/1992 Broersma .
5,129,108 7/1992 Copeland et al. .
5,136,728 8/1992 Kamata .
5,170,510 12/1992 Nava .
5,170,511 12/1992 Kamata .
5,212,843 5/1993 Kamata .
5,231,703 8/1993 Garneau .
5,271,102 12/1993 Fenling .
5,333,328 8/1994 Roberts .
5,337,421 8/1994 Jeng .
5,345,614 9/1994 Tanaka .
5,388,277 2/1995 Taniuchi .
5,388,278 2/1995 Taniuchi .
5,448,780 9/1995 Gath .
5,450,631 9/1995 Egger .
5,502,843 4/1996 Strickland .
5,551,094 9/1996 Navone .
5,581,819 12/1996 Garneau .
5,606,784 3/1997 Hamamoto ..... 24/667
5,621,923 4/1997 Tapocik .
5,675,843 10/1997 Grim et al. .
5,680,656 10/1997 Gath .
5,724,681 3/1998 Sykes .

HELMET WITH ROTATABLE ACCESSORY MOUNT AND METHOD OF MAKING THE SAME

FIELD OF THE INVENTION

The present invention relates to helmets, and more particularly to a helmet attachment apparatus for removably and rotatably attaching accessories to helmets.

BACKGROUND OF THE INVENTION

Lightweight helmets for head protection during bicycle riding falls and accidents have continuously evolved and undergone numerous improvements in recent years. One particular area of refinement has been in the removable attachment of visors to helmets.

U.S. Pat. No. 5,621,923 discloses an interface apparatus that uses screws to attach the visor and a chin guard to the helmet. However, modern lightweight bicycle helmets are formed with a thin hard plastic shell surrounding a lightweight foam liner. The foam provides very minimal support for the screws, and the minimal screw/shell contact provides insufficient support and tends to wear and be unusable after a number of detachments and reattachments. More importantly, such a visor mounting scheme does not provide the wearer the ability to easily adjust the visor position for varying degrees of protection from the sun. As a wearer rides toward the sun, the desired position of the visor will vary depending upon personal preference and the position of the sun relative to the wearer's head at any give time.

U.S. Pat. No. 5,333,328 discloses using hook and loop fastening patches to removably attach a visor to a helmet. While such an attachment technique provides an adjustable attachment between helmet and visor, it is not convenient, and in fact quite difficult, for the wearer to adjust the visor position (especially while riding). For example, as a wearer rides away from the sun, a higher visor position is desired for increased visibility. However, as the wearer rides toward the sun, and/or as the sun drops lower in the sky, lower visor positions are desired for increased protection from the sunlight. Removing and reattaching the hook and loop fastening patches is difficult to perform while riding, and is especially cumbersome if the wearer desires making many visor position changes while riding conditions change.

There is a need for a modern, lightweight helmet with an attachment apparatus that removably and adjustably secures a helmet accessory such as a visor to the helmet. Such an attachment apparatus needs to securely attach the helmet visor to the helmet, yet be easily adjustable, reliable, inexpensive, and easy to manufacture.

SUMMARY OF THE INVENTION

The present invention solves the aforementioned problems by providing an attachment apparatus in a lightweight helmet for removably and adjustably attaching a helmet accessory with a mounting member to the helmet. The helmet includes an inner liner member for substantially covering a wearer's head, and an outer shell member that includes an upper shell surface, a lower shell surface which substantially covers an upper liner surface of the inner liner member, and at least one mounting hole formed therethrough. A grommet with an access hole formed therethrough is attached to the outer shell so that the access hole is aligned with the mounting hole. An engagement member is rotatably attached to the grommet with a predetermined amount of friction therebetween, and has means for engaging a helmet accessory mounting member inserted through the access hole. The predetermined amount of friction is selected to be low enough to allow a wearer to rotate the helmet accessory, mounted to the helmet by the helmet accessory mounting member engaged with the engaging means, between various rotational positions, yet high enough to selectively hold the helmet accessory in any of the various rotational positions.

In another aspect of the present invention, the helmet includes an inner liner member for substantially covering a wearer's head, and an outer shell member that includes an upper shell surface, a lower shell surface which substantially covers an upper liner surface of the inner liner member, and at least one mounting hole formed therethrough. A grommet with an access hole formed therethrough is attached to the outer shell so that the access hole is aligned with the mounting hole. A helmet accessory has at least one mounting member insertable through the access hole. An engagement member is rotatably attached to the grommet with a predetermined amount of friction therebetween, and has means for removably engaging the helmet accessory mounting member inserted through the access hole for removably mounting the helmet accessory to the helmet. The predetermined amount of friction is selected to be low enough to allow a wearer of the helmet to rotate the helmet accessory between various rotational positions, yet high enough to selectively hold the helmet accessory in any of the various rotational positions.

In yet another aspect of the present invention, a method of making a composite helmet to which a helmet accessory having at least one mounting member can be removably attached includes the steps of forming an inner liner member for substantially covering a wearer's head, and forming an outer shell member that includes an upper shell surface, a lower shell surface for substantially covering an upper liner surface of the inner liner member, and at least one mounting hole formed therethrough. A grommet having an access hole is attached to the outer shell such that the access hole is aligned with the mounting hole. An engagement member is rotatably attached to the grommet with a predetermined amount of friction therebetween. The engagement member has means for removably engaging a helmet accessory mounting member from a helmet accessory inserted through the access hole for removably mounting the helmet accessory to the helmet. The predetermined amount of friction is selected to be low enough to allow a wearer of the helmet to rotate the helmet accessory between various rotational positions, yet high enough to selectively hold the helmet accessory in any of the various rotational positions. The upper liner surface of the inner liner member is affixed to the lower shell surface.

In still yet another aspect of the present invention, the helmet of the present invention has an inner liner member for substantially covering a wearer's head, and an outer shell member that includes an upper shell surface, a lower shell surface which substantially covers an upper liner surface of the inner liner member, and at least one mounting hole formed therethrough. A helmet accessory has at least one mounting member. A clutch housing is attached to the mounting hole and includes an access hole formed therein, and an engagement member rotatably disposed inside the clutch housing with a predetermined amount of friction therebetween. The engagement member includes means for removably engaging the helmet accessory mounting member inserted through the access hole for removably mounting the helmet accessory to the outer shell member. The predetermined amount of friction is selected to be low enough to allow a wearer of the helmet to rotate the helmet accessory between various rotational positions yet high enough to selectively hold the helmet accessory in any of the various rotational positions.

In yet one more aspect of the present invention, the helmet of the present invention has an inner liner member for substantially covering a wearer's head, and an outer shell member that includes an upper shell surface, a lower shell surface which substantially covers an upper liner surface of the inner liner member, and at least one mounting hole formed therethrough. A helmet accessory is included. A clutch housing is attached to the helmet accessory and includes an access hole formed therein and an engagement member rotatably disposed inside the clutch housing with a predetermined amount of friction therebetween. The engagement member includes an attachment member extending out through the access hole. A receptacle member is disposed along the lower shell surface and has a receptacle that faces the mounting hole and includes means for removably engaging the attachment member inserted through the mounting hole for removably mounting the clutch housing to the outer shell member. The predetermined amount of friction is selected to be low enough to allow a wearer of the helmet to rotate the helmet accessory between various rotational positions yet high enough to selectively hold the helmet accessory in any of the various rotational positions.

Other objects and features of the present invention will become apparent by a review of the specification, claims and appended figures.

DETAILED DESCRIPTION OF THE PREFERRED EMBODIMENTS

Figure 1A:
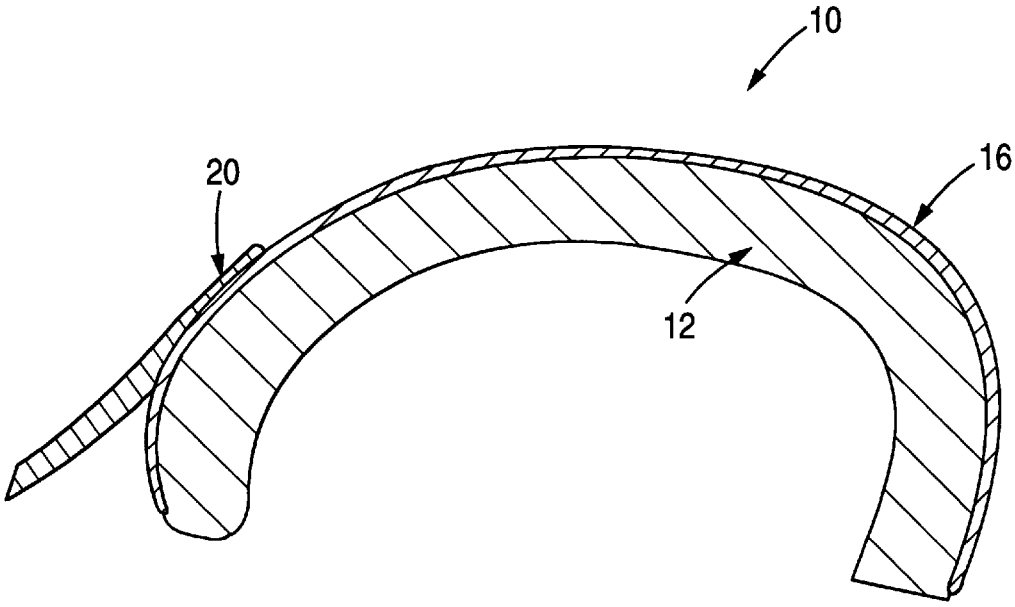
FIG. 1A is a cross-sectional side view of the helmet of the present invention.

While the present invention is applicable to the attachment of various different types of accessories particularly suited for removable and adjustable attachment to bicycle and other sports helmets, the preferred embodiment of the invention is an apparatus for removably attaching a visor in an easily adjustable manner to a lightweight bicycle helmet and will be described with reference thereto as shown in the drawings.

Figure 1B:
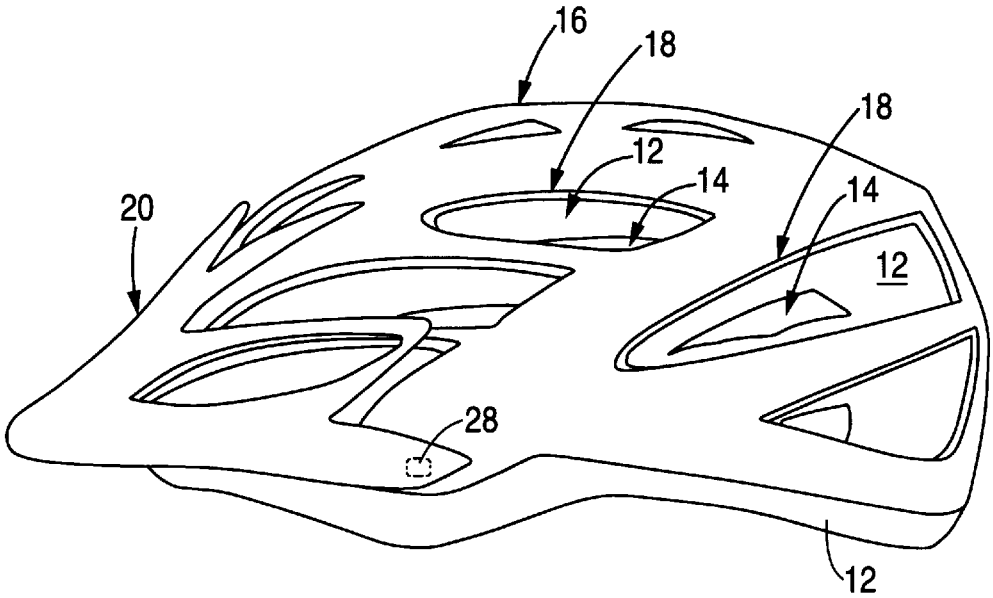
FIG. 1B is a side view of the helmet of the present invention.

Referring now to the drawings, with particular reference to FIGS. 1A and 1B, there is shown a bicycle helmet 10 formed of an expanded foam helmet liner 12 having liner vents 14 formed therethrough. A thin, hard plastic helmet shell 16 is attached to (using tape or an adhesive), or molded integral with (insert molded), the top portion of the liner 12. The shell 16 has shell vents 18 corresponding to the liner vents 14. A visor 20 is removably attached to the helmet 10.

Figure 2:
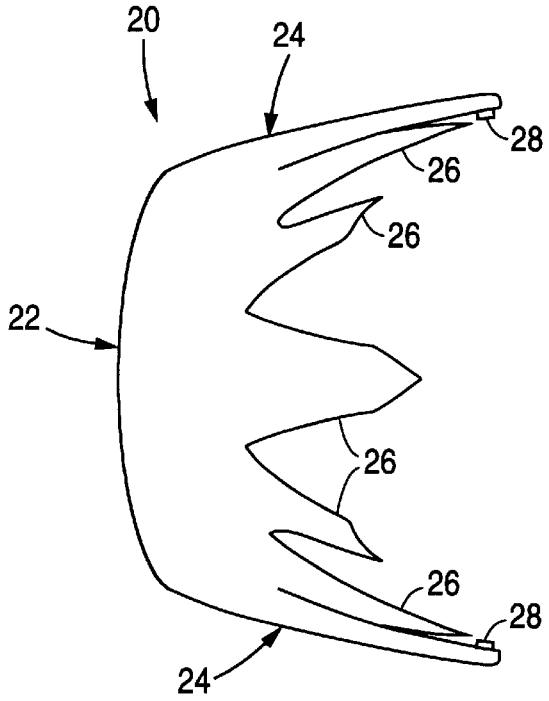
FIG. 2 is a top view of the visor helmet accessory for removable attachment to the helmet of the present invention.

Referring now to FIG. 2, the visor 20 has a front portion 22 which projects forwardly over the front edge of the helmet to shield the eyes of the wearer. Side portions 24 extend rearwardly from the two sides of the front portion 22, and front upward extensions 26 overlap the shell 16 between the shell and liner vents 18/14, which serves to aerodynamically carry air from the front of the helmet into the helmet vents 18/14. A pair of attachment protrusions 28 are integrally formed at the rearward ends of the side portions 24 to removably attach the visor 20 to the helmet 10.

Figure 3A:
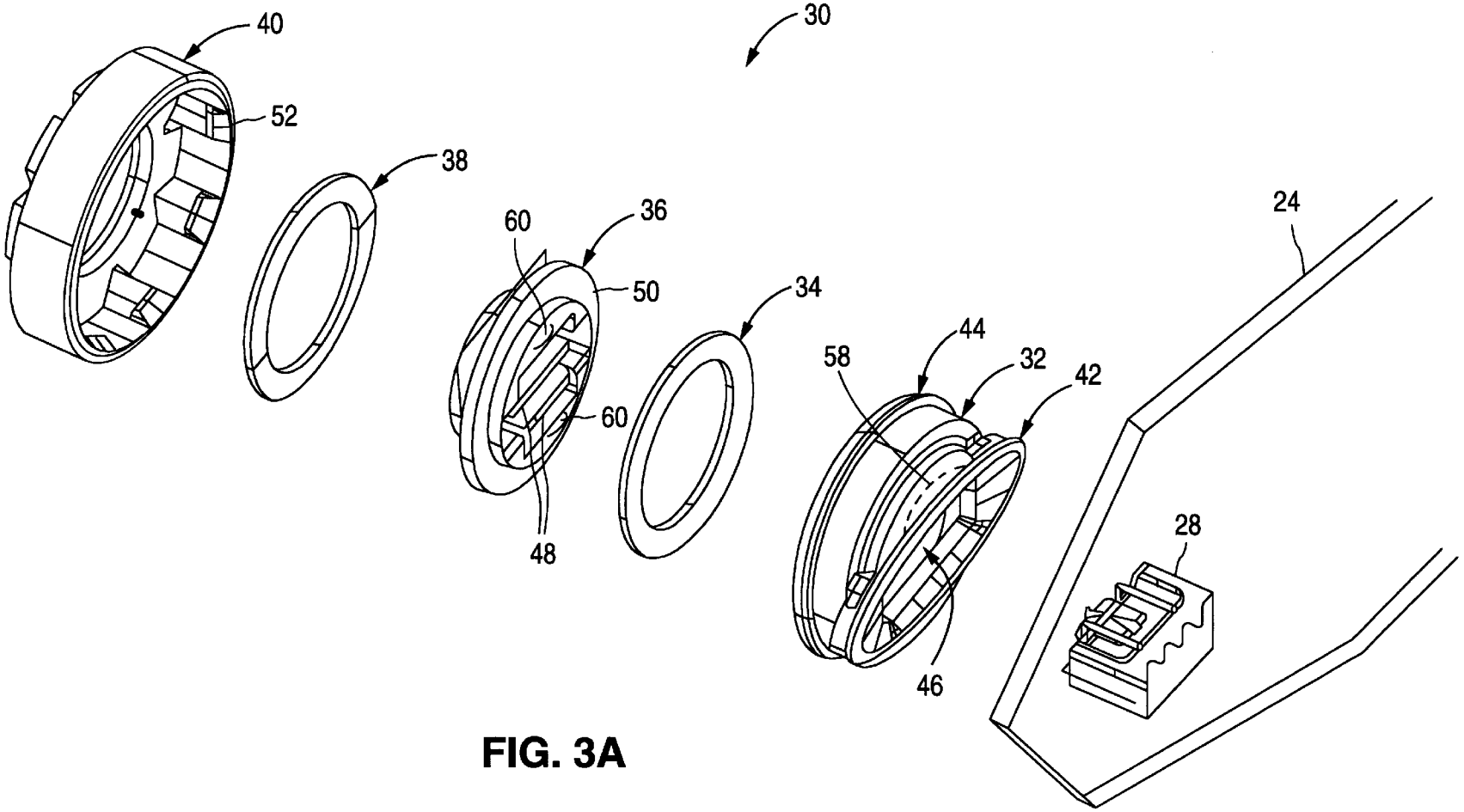
FIG. 3A is an exploded perspective view of the clutch assembly of the present invention.
Figure 3B:
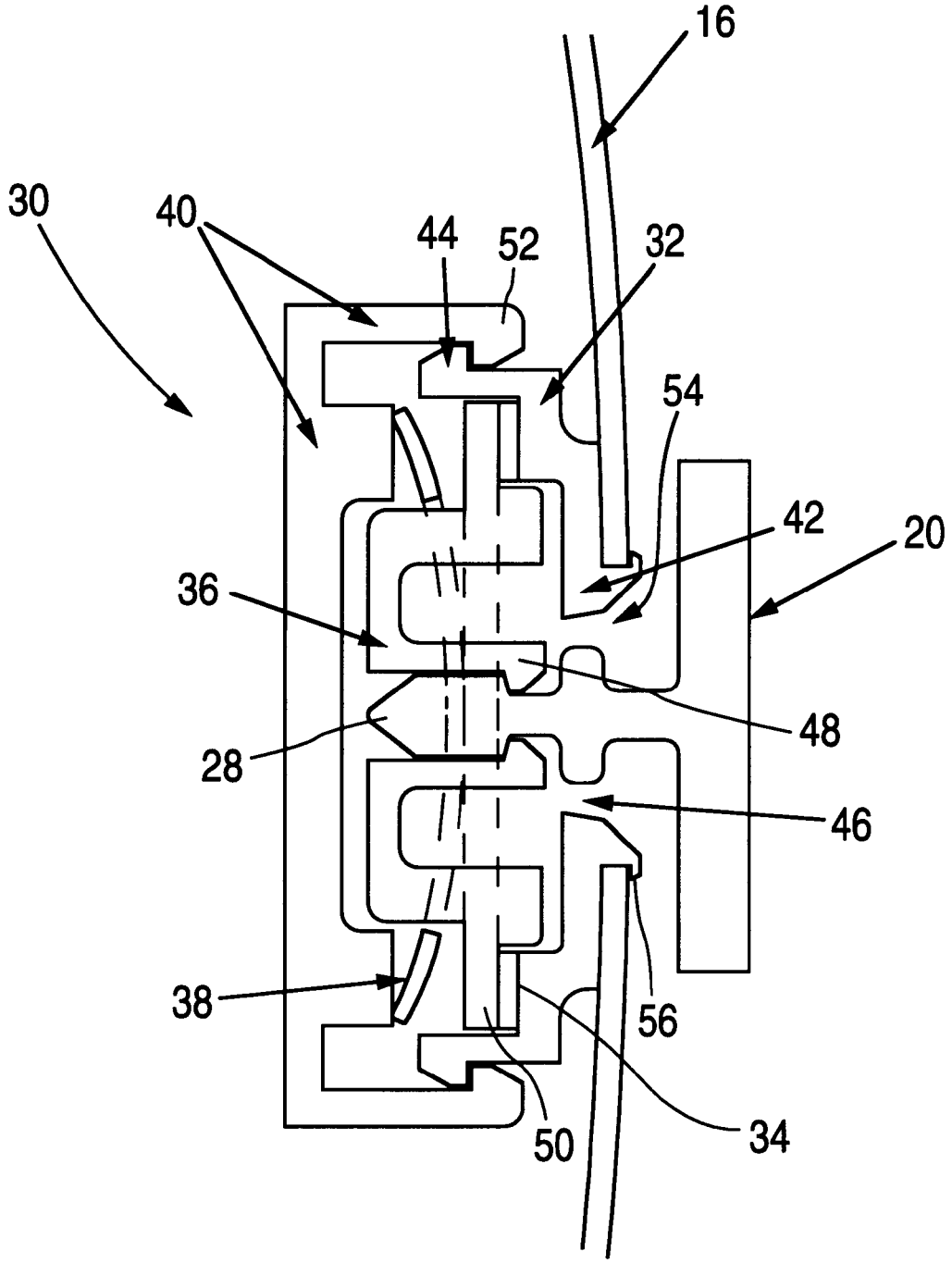
FIG. 3B is a side cross-sectional view of the visor protrusion engaged with the clutch assembly of the present invention.
Figure 3C:
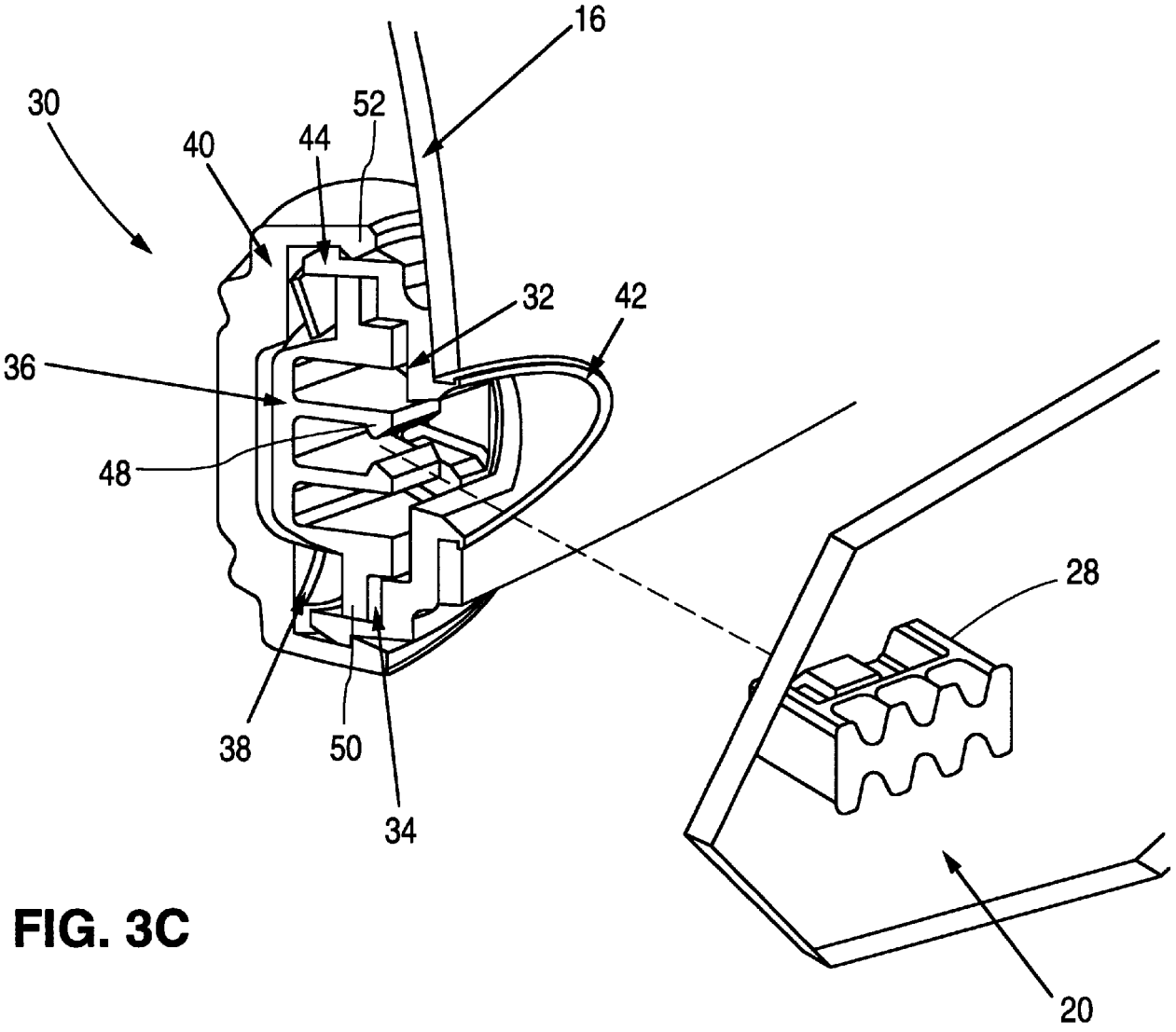
FIG. 3C is a perspective, partial cross-sectional view of the clutch assembly of the present invention.

Referring specifically to FIGS. 3A–3C, a pair of clutch assemblies 30 are attached to shell 16 for rotatably attaching the visor 20 to the sides of helmet 10. Clutch assembly 30 includes a grommet 32, friction washer 34, a ring member 36, a spring washer 38 and a rear cap member 40. Grommet 32 has an elongated shaped flange portion 42, an annular ridge portion 44, and an elongated shaped access hole 46 formed therethrough. The ring member 36 includes a pair of opposing engagement prongs 48 inside an outer ring portion 50. Rear cap member 40 is cylindrically shaped and includes a plurality of engagement tabs 52 formed therein.

A pair of elongated mounting holes 54 are formed in the sides of helmet shell 16 at the locations at which the visor 20 attaches to the helmet 10. FIGS. 3B and 3C illustrate the clutch assembly 30 attached to mounting holes 54. Clutch assembly 30 is assembled by placing friction washer 34 inside grommet 32, followed by the ring member 36 with prongs 48 facing access hole 46, followed by spring 38. Then, rear cap member 40 is pressed onto grommet 32, against the bias force of spring 38, until tabs 52 engage and snap together with annular ridge 44. Once assembled, spring 38 exerts a bias force that presses ring member 36 against friction washer 34, which in turn is pressed against grommet 32. Ring member 36 is rotatable inside clutch assembly 30 against the friction of washer 34 sliding against ring member 36 and/or grommet 32. Either before or after assembly of clutch assembly 30, flange 42 is pushed through from the inside of shell 16 to engage one of the mounting holes 54 in shell 16. In the preferred embodiment, flange 42 includes an outer flange ridge 56 that engages the rim of mounting hole 54 to hold clutch assembly 30 in place and keep it from rotating. Also in the preferred embodiment, arcuate ridges 58 and recesses 60 of grommet 32 and ring member 36 slidably engage each other to limit the angle of rotation between these elements to approximately 15 degrees, which prevents prongs 48 from being so misaligned to elongated access hole 46 that they cannot be engaged by protrusions 28. Alternately, the shape and size of the grommet access hole 46 can be selected to engage with and limit the rotation of the prongs 48.

To mount the visor 20 to helmet 10, visor attachment protrusions 28 are inserted into the respective grommet access holes 46 to engage prongs 48 of ring member 36 (see FIGS. 3B and 3C). The visor 20 is removed from helmet 10 by pulling the visor side portions 24 away from helmet 10 with sufficient force to disengage attachment protrusions 28 from engagement prongs 48.

The present invention securely and removably fastens the visor 20 to helmet 10 in a rotatable manner. The friction between friction washer 34, and ring member 36 and grommet 32, provides sufficient resistance to hold the visor at any given predetermined angular orientation. When the wearer wants to raise or lower the visor position, the wearer need only grab visor 20 and rock it up or down against the resistance provided by friction washer 34 until the visor 20 is in its new desired position. This visor angular adjustment is easy, quick, and only requires one hand to perform. The amount of resistance against visor movement is determined by the force exerted by spring 38 and the frictive material used to form washer 34. These elements are selected so that the visor movement resistance is high enough to hold the visor in place during use, but low enough so the wearer can adjust the visor position by grabbing and moving the visor.

In the preferred embodiment, foam liner 12 is formed of any expanded foam material, such as expanded polystyrene or expanded polypropylene. Grommet 32, ring member 36 and rear cap 40 are preferably made of nylon or ABS plastic, which are relatively slippery materials. Friction washer 34 is preferably made of rubber to add the necessary resistive friction between ring member 36 and grommet 32 to hold visor 20 in place during use. Spring washer 38 is preferably made of stainless or high tensile steel. To prevent any rotation of the clutch assembly itself, flanges 42 and mounting holes 54 are elongated in shape. Further, visor protrusions 28 and prongs 48 are elongated for secure attachment therebetween.

Figure 4:
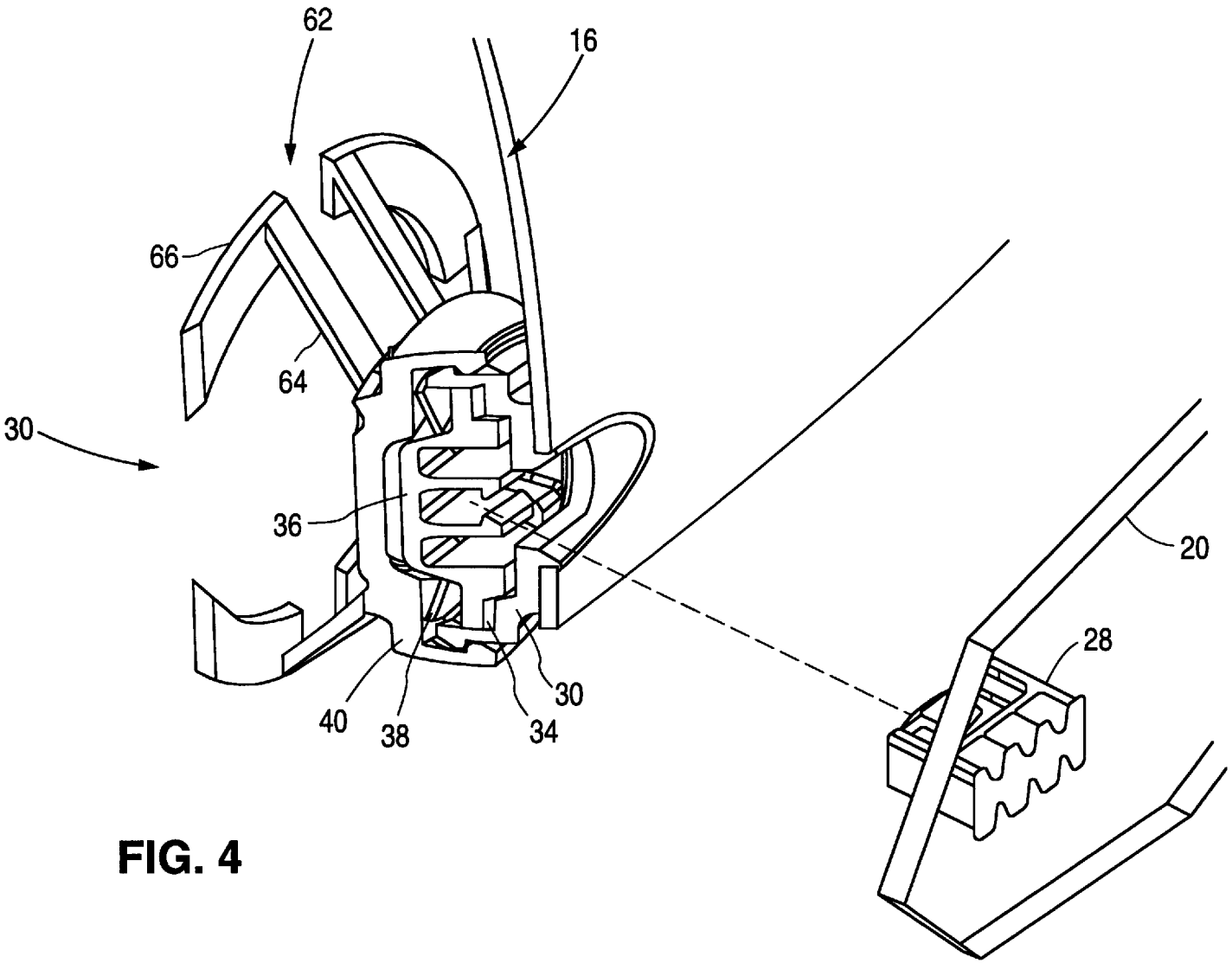
FIG. 4 is a perspective, partial cross-sectional view of an alternate embodiment of the clutch assembly of the present invention.

FIG. 4 illustrates an alternate embodiment of the present invention. For some helmet designs, additional support of the clutch assembly may be necessary to prevent the clutch assembly from becoming loose from the helmet 10. With this second embodiment, the clutch assembly 30 is not only held in place by engagement between flange 42 and shell mounting hole 54, but also by engagement of cap member 40 with foam liner 12. Specifically, an anchor member 62 with leg members 64 and ring shaped cross members 66 extend from the back side of cap member 40.

With this second embodiment, before the foam liner 12 is attached or formed to helmet shell 16, the clutch assemblies 30 (which include anchors 62) are assembled and attached to the respective shell mounting holes 54. The expanded foam liner 12 is then formed preferably by an insert molding process, in which the helmet shell 16 is coated with an adhesive and placed into a mold, and the foam liner 12 is formed by injection molding the foam liner material (preferably expanded polystyrene or expanded polypropylene) to the inside surface of shell 16 and around anchor members 62. The anchor members 62, which are fully embedded in the foam liner 12, help hold the clutch assemblies 30 in place during use. The anchor members 62 are especially effective in securing clutch assemblies 30 in place since leg members 64 extend into the foam liner 12 and cross members 66 traverse through the foam liner 12 at different angle(s) than the leg members 64 thus engaging a large volume of the foam liner 12.

Figure 5:
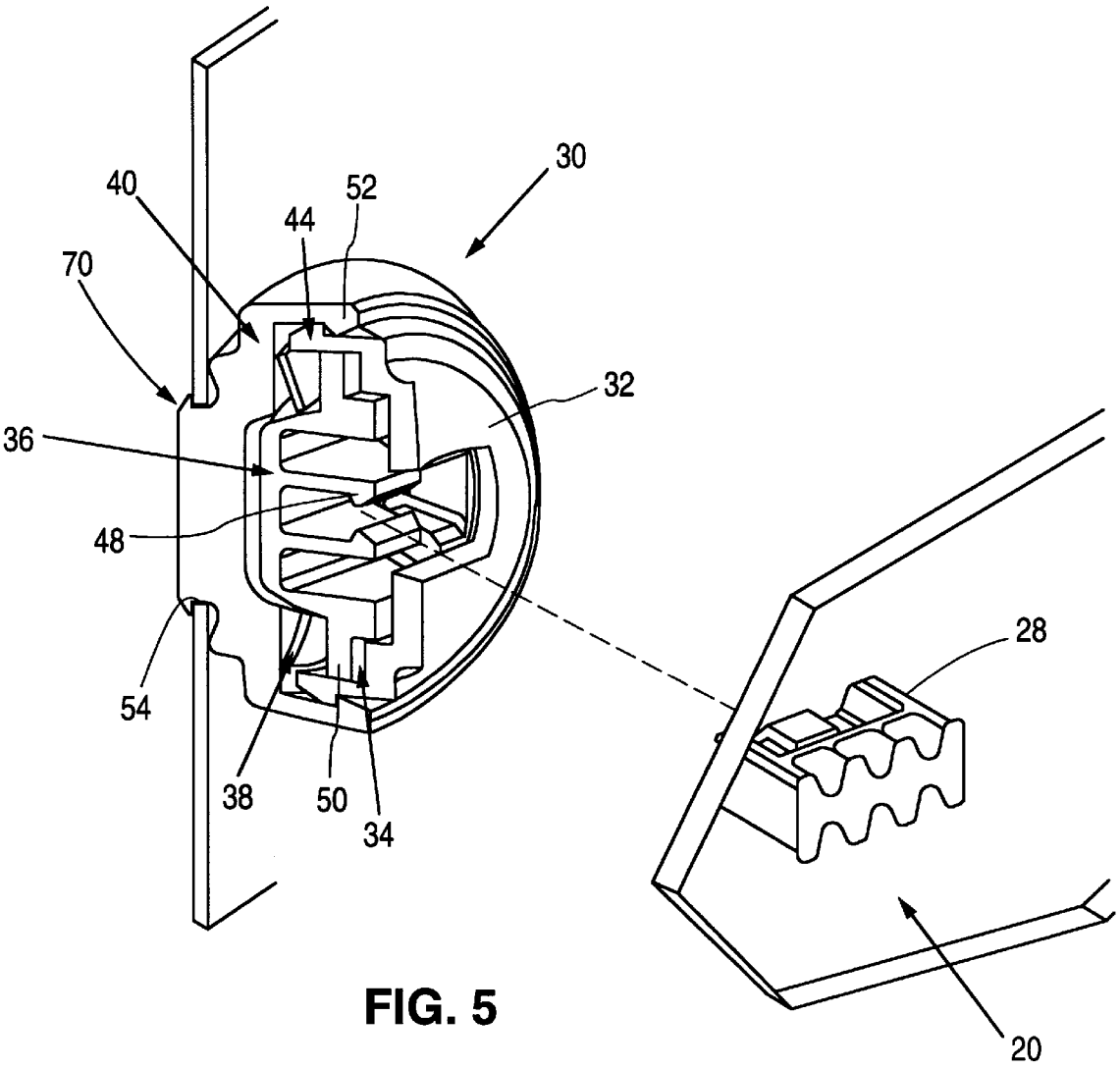
FIG. 5 is a perspective, partial cross-sectional view of a second alternate embodiment of the present invention.

FIG. 5 illustrates a second alternate embodiment of the present invention, where the clutch assembly 30 is disposed on the outer surface of shell 16. Specifically, the cap member 40 includes a flange 70 on its outer surface that engages, and supports the clutch assembly 30 to, shell mounting hole 54. Flange 70 can be sized to permanently, semi-permanently, or removably engage mounting hole 54 to support clutch assembly 30 thereto.

Figure 6A:
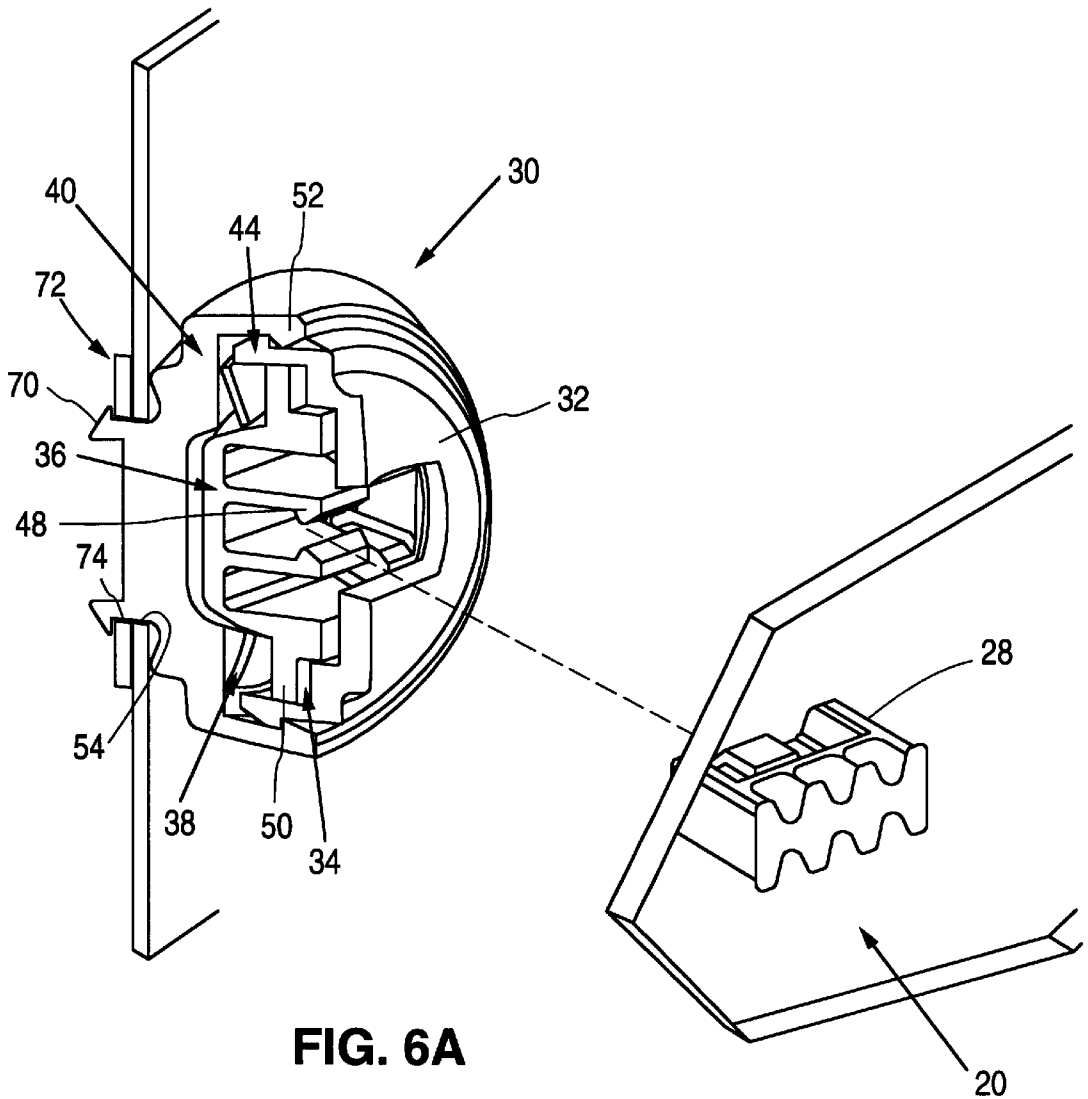
FIGS. 6A and 6B are perspective, partial cross-sectional views of alternate attachment configurations for the second alternate embodiment of the present invention.
Figure 6B:
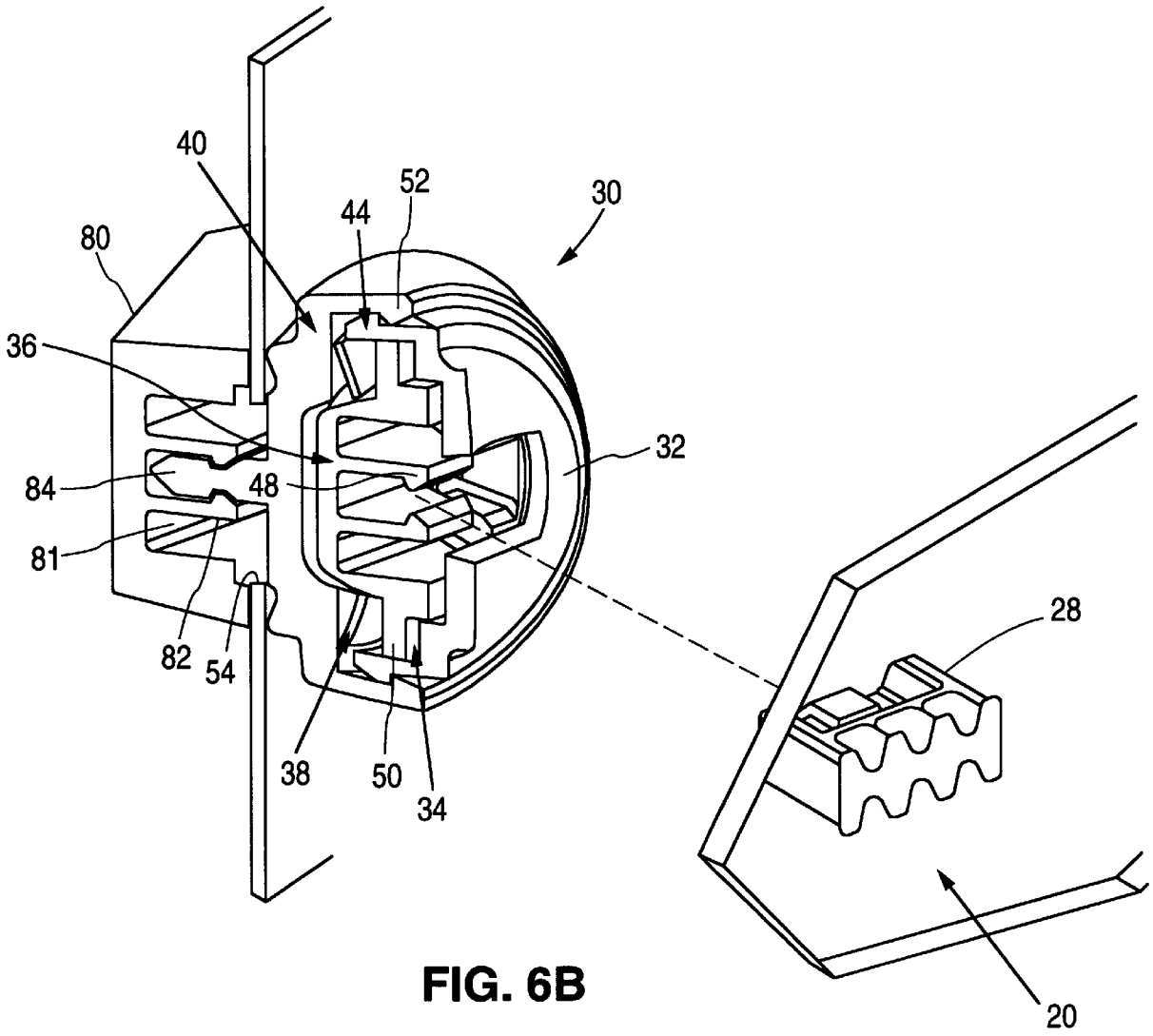

FIGS. 6A and 6B illustrate alternate configurations for attaching clutch assembly 30 to the shell 16. In FIG. 6A, a second grommet 72 with a hole 74 is disposed on the inside surface of the shell, and flange 70 of clutch assembly 30 engages the inner rim of hole 74 to secure these elements to shell 16. Alternately, FIG. 6B illustrates a receptacle member 80 disposed on the inside surface of shell 16 with a receptacle 81 having engagement prongs 82 therein faces shell mounting hole 54. A second attachment protrusion 84 is attached or formed to cap member 40 to engage engagement prongs 82. With this attachment configuration, the visor 20 is removably and rotatably attached to the clutch assembly 30, which is in turn removably attached to the helmet 10 via receptacle member 80. Thus, the user can directly engage the visor attachment protrusions 28 with the receptacle member 80 for direct, un-rotatable mounting of visor 20 to helmet 10, or rotatably attach the visor 20 to clutch assembly 30, and attach the clutch assembly 30 to the receptacle member 80, for rotatably mounting of visor 20 to helmet 10.

Figure 7:
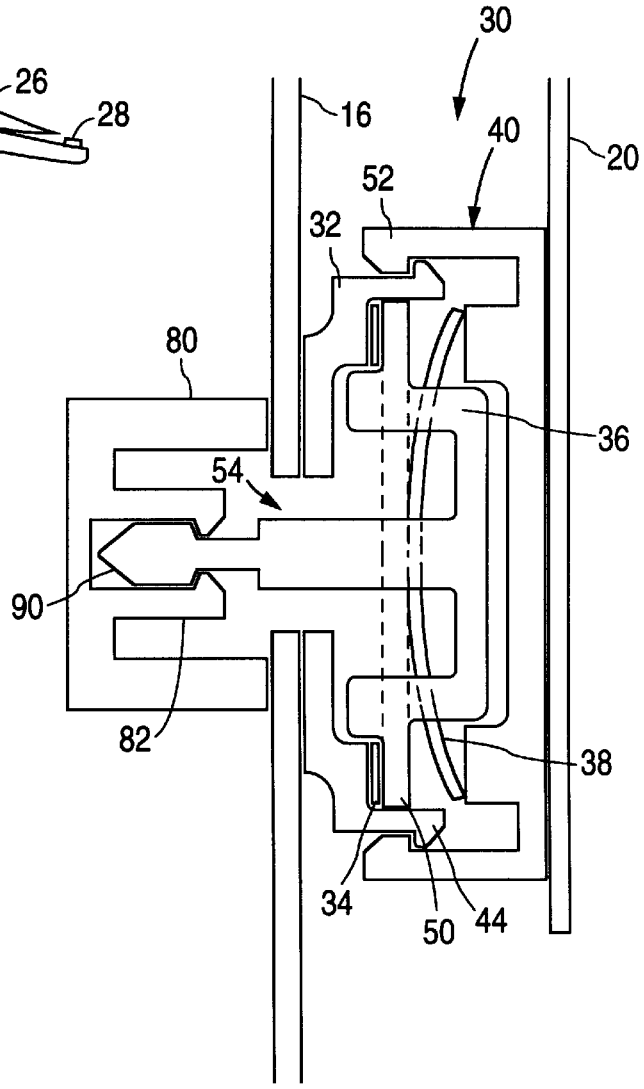
FIG. 7 is a side cross-sectional view of the third alternate embodiment of the present invention.

FIG. 7 illustrates a third alternate embodiment of the present invention, where clutch assembly 30 is affixed or integrally formed to the visor 20, and the clutch assembly 30 is rotatably attached to the helmet 10. More specifically, cap member 40 is affixed to the visor 20, and the ring member 36 includes an attachment protrusion 90 instead of prongs 48. A receptacle member 80 with engagement prongs 82 is attached to the inner surface of shell 16 and facing mounting hole 54. Thus, the clutch assembly 30 rotates relative to helmet 16, and visor 20 (with clutch assembly 30) is removably and rotatably attached to the shell 16 with no elements protruding from shell 16 when the visor 20 (with clutch assembly 30) is detached from the helmet 10.

It is to be understood that the present invention is not limited to the embodiments described above and illustrated herein, but encompasses any and all variations falling within the scope of the appended claims. For example, the clutch assembly of the present invention can be used to removably and rotatably attach other types of accessories to the helmet instead of just visors, such as rear-view mirrors, lights, microphones, eye shields, face shields, etc. Further, it is not necessary to fully assemble and attach the clutch assemblies having anchors to the helmet before the foam liner is insert molded to shell. Instead, just the rear cap member with the anchors formed thereto need be insert molded to the liner. Lastly, while prongs and engagement protrusions are shown for removable engagement between members, other such mutually engageable members can be used, such as ball and hole connectors, snap connectors, etc.

What is claimed is:

1. A helmet for rotatable attachment with a helmet accessory having at least one mounting member, comprising:

an inner liner member for substantially covering a wearer's head;

an outer shell member that includes:

an upper shell surface, a lower shell surface which substantially covers an upper liner surface of the inner liner member, and at least one mounting hole formed therethrough;

a grommet with an access hole formed therethrough and attached to the outer shell so that the access hole is aligned with the mounting hole; and an engagement member that is rotatably attached to the grommet with a predetermined amount of friction therebetween and has means for engaging a helmet accessory mounting member inserted through the access hole, wherein the predetermined amount of friction is selected to be low enough to allow a wearer to rotate a helmet accessory, mounted to the helmet by the helmet accessory mounting member engaged with the engaging means, between various rotational positions yet high enough to selectively hold the helmet accessory in any of the various rotational positions.

2. The helmet of claim 1, further comprising:

a friction washer disposed between the engagement member and grommet for producing the predetermined amount of friction therebetween.

3. The helmet of claim 2, further comprising:

a spring for biasing the engagement member and the grommet together with the friction washer disposed therebetween.

4. The helmet of claim 1, further comprising:

a cap member for rotatably securing the engagement member to the grommet.

5. The helmet of claim 4, further comprising:

an anchor member that is connected to the cap member and which extends into the inner liner member.

6. The helmet of claim 5, wherein the anchor member includes:

at least one leg member portion extending in one direction away from the cap member and into the inner liner member, and a least one cross member portion which traverses through the inner liner member in a different direction than the one direction to prevent the anchor member from becoming detached from the inner liner member.

7. The helmet of claim 6, wherein the inner liner member is insert molded to the outer shell.

8. The helmet of claim 1, wherein the engagement means includes a pair of opposing prongs for engaging a helmet accessory mounting member.

9. The helmet of claim 1, wherein the mounting hole has a non-circular shape.

10. The helmet of claim 9, wherein the grommet has a non-circularly shaped flange for engaging the mounting hole.

11. The helmet of claim 1, wherein one of the engagement member and the grommet includes a tab engaged with a recess of the other of the engagement member and the grommet to limit the rotation of the engagement member to a predetermined angular range.

12. A helmet, comprising:

an inner liner member for substantially covering a wearer's head;

an outer shell member that includes:

an upper shell surface, a lower shell surface which substantially covers an upper liner surface of the inner liner member, and at least one mounting hole formed therethrough;

a grommet with a access hole formed therethrough and attached to the outer shell so that the access hole is aligned with the mounting hole;

a helmet accessory having at least one mounting member insertable through the access hole; and an engagement member that is rotatably attached to the grommet with a predetermined amount of friction therebetween and has means for removably engaging the helmet accessory mounting member inserted through the access hole for removably mounting the helmet accessory to the outer shell member, wherein the predetermined amount of friction is selected to be low enough to allow a wearer of the helmet to rotate the helmet accessory between various rotational positions yet high enough to selectively hold the helmet accessory in any of the various rotational positions.

13. The helmet of claim 12, further comprising:

a friction washer disposed between the engagement member and grommet for producing the predetermined amount of friction therebetween.

14. The helmet of claim 13, further comprising:

a spring for biasing the engagement member and the grommet together with the friction washer disposed therebetween.

15. The helmet of claim 12, further comprising:

a cap member for rotatably securing the engagement member to the grommet.

16. The helmet of claim 15, further comprising:

an anchor member that is connected to the cap member and which extends into the inner liner member.

17. The helmet of claim 16, wherein the anchor member includes:

at least one leg member portion extending in one direction away from the cap member and into the inner liner member, and a least one cross member portion which traverses through the inner liner member in a different direction than the one direction to prevent the anchor member from becoming detached from the inner liner member.

18. The helmet of claim 17, wherein the inner liner member is insert molded to the outer shell.

19. The helmet of claim 12, wherein the engagement means includes a pair of opposing prongs for engaging the helmet accessory mounting member.

20. The helmet of claim 12, wherein the mounting hole has a non-circular shape.

21. The helmet of claim 20 wherein the grommet has a non-circularly shaped flange for engaging the mounting hole.

22. The helmet of claim 12, wherein one of the engagement member and the grommet includes a tab engaged with a recess of the other of the engagement member and the grommet to limit the rotation of the engagement member to a predetermined angular range.

23. A method of making a composite helmet to which a helmet accessory having at least one mounting member can be removably attached, the method comprising the steps of:

forming an inner liner member for substantially covering a wearer's head;

forming an outer shell member that includes an upper shell surface, a lower shell surface for substantially covering an upper liner surface of the inner liner member, and at least one mounting hole formed therethrough;

attaching a grommet having an access hole to the outer shell such that the access hole is aligned with the mounting hole;

rotatably attaching an engagement member to the grommet with a predetermined amount of friction therebetween, wherein the engagement member has means for removably engaging a helmet accessory mounting member from a helmet accessory inserted through the access hole for removably mounting the helmet accessory to the outer shell member, wherein the predetermined amount of friction is selected to be low enough to allow a wearer of the helmet to rotate the helmet accessory between various rotational positions yet high enough to selectively hold the helmet accessory in any of the various rotational positions; and affixing the upper liner surface of the inner liner member to the lower shell surface.

24. The method of claim 23, wherein the inner liner forming step and the affixing step are performed by insert molding the inner liner member to the outer shell member.

25. The method of claim 24, wherein a cap member is attached to the grommet for rotatably securing the engagement member thereto, and wherein an anchor member is connected to the cap member so that the inner liner member is integrally molded around the anchor member.

26. The method of claim 25, wherein the anchor member includes:

at least one leg member portion extending in one direction away from the cap member and into the inner liner member, and a least one cross member portion which traverses through the inner liner member in a different direction than the one direction to prevent the anchor member from becoming detached from the inner liner member.

27. A helmet, comprising:

an inner liner member for substantially covering a wearer's head;

an outer shell member that includes:

an upper shell surface, a lower shell surface which substantially covers an upper liner surface of the inner liner member, and at least one mounting hole formed therethrough;

a helmet accessory having at least one mounting member; and a clutch housing attached to the mounting hole, the clutch housing including:

an access hole formed therein, and an engagement member rotatably disposed inside the clutch housing with a predetermined amount of friction therebetween, the engagement member includes means for removably engaging the helmet accessory mounting member inserted through the access hole for removably mounting the helmet accessory to the outer shell member;

wherein the predetermined amount of friction is selected to be low enough to allow a wearer of the helmet to rotate the helmet accessory between various rotational positions yet high enough to selectively hold the helmet accessory in any of the various rotational positions.

28. The helmet of claim 27, further comprising:

a friction washer disposed between the engagement member and the housing for producing the predetermined amount of friction therebetween.

29. The helmet of claim 28, further comprising:

a spring for biasing the engagement member to the housing with the friction washer disposed therebetween.

30. The helmet of claim 27, wherein the engagement means includes a pair of opposing prongs for engaging the helmet accessory mounting member.

31. The helmet of claim 27, where in the mounting hole has a non-circular shape.

32. The helmet of claim 31 wherein the housing has a non-circularly shaped flange for engaging the mounting hole.

33. The helmet of claim 27, further comprising:

a grommet disposed a long the lower shell surface adjacent the mounting hole; and the housing further includes a flange member for engaging the grommet.

34. The helmet of claim 27, further comprising:

an attachment member extending from the housing; and a receptacle member disposed along the lower shell surface and having a receptacle that faces the mounting hole and that includes means for removably engaging the attachment member inserted through the mounting hole for removably mounting the clutch housing to the outer shell member.

35. A helmet, comprising:

an inner liner member for substantially covering a wearer's head;

an outer shell member that includes:

an upper shell surface, a lower shell surface which substantially covers an upper liner surface of the inner liner member, and at least one mounting hole formed therethrough;

a helmet accessory;

a clutch housing attached to the helmet accessory, the clutch housing including:

an access hole formed therein, and an engagement member rotatably disposed inside the clutch housing with a predetermined amount of friction therebetween, the engagement member includes an attachment member extending out through the access hole; and a receptacle member disposed along the lower shell surface and having a receptacle that faces the mounting hole and that includes means for removably engaging the attachment member inserted through the mounting hole for removably mounting the clutch housing to the outer shell member;

wherein the predetermined amount of friction is selected to be low enough to allow a wearer of the helmet to rotate the helmet accessory between various rotational positions yet high enough to selectively hold the helmet accessory in any of the various rotational positions.

36. The helmet of claim 35, further comprising:

a friction washer disposed between the engagement member and the housing for producing the predetermined amount of friction therebetween.

37. The helmet of claim 36, further comprising:

a spring for biasing the engagement member to the housing with the friction washer disposed therebetween.

38. The helmet of claim 35, wherein the engagement means includes a pair of opposing prongs for engaging the attachment member.

39. The helmet of claim 35, wherein the mounting hole has a non-circular shape.

* * * * *